US007134461B2

(12) United States Patent
Takada

(10) Patent No.: US 7,134,461 B2
(45) Date of Patent: Nov. 14, 2006

(54) PENCIL SHARPENER

(75) Inventor: Tokinori Takada, Chiba (JP)

(73) Assignee: KTF Corporation, Tokyo (JP)

( * ) Notice: Subject to any disclaimer, the term of this patent is extended or adjusted under 35 U.S.C. 154(b) by 0 days.

(21) Appl. No.: 11/247,285

(22) Filed: Oct. 12, 2005

(65) Prior Publication Data

US 2006/0086416 A1 Apr. 27, 2006

(30) Foreign Application Priority Data

Oct. 13, 2004 (JP) ..... 2004-299182

(51) Int. Cl.
*B43L 23/02* (2006.01)

(52) U.S. Cl. ..... 144/28.72; 144/28.5

(58) Field of Classification Search ..... 144/28.1–28.7, 144/28.72, 28.8, 28.9; 30/451, 457, 460–462
See application file for complete search history.

(56) References Cited

U.S. PATENT DOCUMENTS 3,650,308 A * 3/1972 Hori ..... 144/28.5
3,937,239 A * 2/1976 Bosland ..... 144/28.5
5,875,555 A * 3/1999 Andrisin et al. ..... 30/452
6,886,614 B1 * 5/2005 Ricono et al. ..... 144/28.11

FOREIGN PATENT DOCUMENTS

JP 2002-192891 7/2002
JP 2003-154791 5/2003

OTHER PUBLICATIONS

English Language Abstract of JP 2003-154791.
English Language Abstract of JP 2002-192891.

* cited by examiner

*Primary Examiner*—Derris H. Banks
*Assistant Examiner*—Shelley Self
(74) *Attorney, Agent, or Firm*—Greenblum & Bernstein, P.L.C.

(57) ABSTRACT

A pencil sharpener includes a frame, a drive mechanism, a transmission mechanism, a cutting mechanism, and a pencil-core adjustment mechanism. The pencil-core adjustment mechanism is constituted of a core stopper shaft, an elastic body, and a core adjustment switch constituted of electrode plates aligned in parallel. A pencil inserted into the cutting mechanism presses against and turns ON a switch provided in the drive mechanism to transmit power from the electric power supply unit to the drive device, thereby operating the cutting mechanism via the transmission mechanism to sharpen the pencil. When the pencil is pressed against the upper end of the core stopper shaft, a disk of the core stopper shaft contacts and pushes down one end of the longer electrode plate to separate the projection of the longer electrode plate from the shorter electrode plate, thereby turning OFF the core adjustment switch.

14 Claims, 6 Drawing Sheets

PENCIL SHARPENER

BACKGROUND OF THE INVENTION

1. Field of the Invention

The present invention relates to an electric pencil sharpener for shaving the tip of a pencil, particularly an electric pencil sharpener that is small and light in weight, still more particularly to a pencil sharpener that not only is small and light in weight but also has pencil-core adjustment capability.

2. Description of Related Art

Pencil sharpeners for office use can be classified as either electric (power) or manual. Some electric pencil sharpeners are driven by a battery and others are capable of automatically shaving (sharpening) a pencil using ac line current supplied from a wall socket. One feature of an electric pencil sharpener is that it operates automatically when a pencil is inserted into the sharpening hole. Although a rechargeable pencil sharpener is conceivable, a structure that is small and light in weight has been difficult to achieve.

Most manual pencil sharpeners are either small ones that can be carried on one's person or desktop ones that are manually operated by turning a crank. The small pencil sharpener is equipped with a single-edge cutting blade and sharpening is performed by turning either the pencil or the pencil sharpener by hand. The desktop pencil sharpener is used by inserting a pencil into the hole and turning the crank to perform sharpening.

A pencil sharpener with pencil-core adjustment capability is taught by Japanese Laid-open Patent Application No. 2003-154791. This is a manual pencil sharpener is equipped inward of cutting blades with a projection that a pencil strikes on when inserted. The thickness and length of the pencil-core can be adjusted by sliding this projection. Moving the projection deep into the cutting mechanism enables a pencil to strike on the projection immediately after shaving, thereby enabling sharpening of a pencil having a thick core. Shallow insertion enables deep shaving of the pencil, so that a pencil having a long core can be sharpened.

However, portable electric pencil sharpeners are not yet in widespread use and, notably, no portable electric pencil sharpener capable of adjusting core length has been made available.

A need has therefore been felt for development of a light-weight, compact pencil sharpener with core length adjustment capability that can automatically sharpen pencils.

Related background art can also be found in Japanese Laid-open Patent Application No. 2002-192891.

SUMMARY OF THE INVENTION

An object of the present invention is overcome the foregoing problem by providing a pencil sharpener powered by a rechargeable battery (cell) or dry battery (cell) which has two parallel electrode plates provided with projections for establishing a conductive state and enables cutting operation to be turned off after insertion of a pencil by a core stopper shaft that breaks the conductive state of the electrode plates.

In order to achieve this object, the present invention provides a pencil sharpener comprising a frame, a drive mechanism composed of a drive device and an electric power supply unit, a transmission mechanism comprising a gear train for transmitting power from the drive mechanism, a cutting mechanism equipped with at least one cutting blade that is driven by power from the transmission mechanism to shave a pencil, and a pencil-core adjustment mechanism straddling the drive mechanism and cutting mechanism for adjusting the thickness of a pencil-core, in which pencil sharpener the pencil-core adjustment mechanism is constituted of a core stopper shaft composed of a disk and an upper end on which the tip of a pencil strikes, an elastic body that is provided with a center hole and pressed by the core stopper shaft, and a core adjustment switch composed of a short electrode plate and a long electrode plate that is formed with a protuberance for contacting the short electrode plate and which extends to enable one end thereof to contact the disk of the core stopper shaft, and in which a pencil inserted into the cutting mechanism presses against and turns ON a switch provided in the drive mechanism to transmit power from the electric power supply unit to the drive device, thereby operating the cutting mechanism via the transmission mechanism to sharpen the pencil, and pressing of the pencil against the upper end of the core stopper shaft causes the disk of the core stopper shaft to contact and press down one end of the long electrode plate to separate the protuberance of the long electrode plate from the short electrode plate, thereby turning OFF the core adjustment switch and stopping the supply of power to terminate the operation.

The present invention also provides a pencil sharpener comprising a frame, a drive mechanism composed of a drive device and an electric power supply unit, a transmission mechanism comprising a gear train for transmitting power from the drive mechanism, a cutting mechanism equipped with at least one cutting blade that is driven by power from the transmission mechanism to shave a pencil, and a pencil-core adjustment mechanism straddling the drive mechanism and cutting mechanism for adjusting the thickness of a pencil-core, in which pencil sharpener the pencil-core adjustment mechanism is constituted of a core stopper shaft composed of an upper end and a lower end that is a rod-like body adapted to enter between electrode plates, an elastic body that is provided with a center hole and pressed by the core stopper shaft, and two electrode plates installed in parallel under the elastic body and provided with projections for making contact at one point, and in which a pencil inserted into the cutting mechanism presses against and turns ON a switch provided in the drive mechanism to transmit power from the electric power supply unit to the drive device, thereby operating the cutting mechanism via the transmission mechanism to sharpen the pencil, and pressing of the pencil against the upper end of the core stopper shaft causes the lower end of the core stopper shaft to enter between the two electrode plates to separate the contacting projections, thereby breaking the contact between the electrode plates and stopping the supply of power to terminate the operation.

The core adjustment switch can be composed of two electrode plates that extend in parallel from a switchbox and move vertically in response to a core adjustment operation from the outside.

For enabling adjustment of pencil-core length, it is possible to make the electrode plates vertically movable and adjust the distance the core stopper shaft moves to enter between the electrode plates. The electric power supply unit can be at least one rechargeable battery or dry battery. The cutting blade can be rotating blade or a single-edge blade.

The core adjustment switch can be configured so that once the lower end of the core stopper shaft is inserted between the two electrode plates the switch of the drive mechanism is maintained OFF until the pencil is extracted.

The core adjustment switch can also be constituted of a slidable slide lever having a sloped surface and a manual adjustment lever, and configured so that sliding the slide lever laterally moves a switchbox at an angle along the sloped surface to move it vertically.

Owing to the configuration as explained in the foregoing, the pencil sharpener according to the present invention offers the following merits:

1. Because the tip of the inserted pencil strikes on the core stopper shaft, the pencil presses down the core stopper shaft, whereby the disk of the core stopper shaft physically and forcibly breaks the electrically conductive state of the mutually contacting electrode plates to enable the cutting operation to be terminated automatically and without malfunction.
2. Because the tip of the inserted pencil strikes on the core stopper shaft, the pencil presses down the core stopper shaft to insert it between the joined electrode plates, thereby physically and forcibly breaking the conductive state to enable the cutting operation to be terminated automatically and without malfunction.
3. The core adjustment switch can be moved vertically.
4. The thickness of the pencil-core can be adjusted by adjusting the distance between the core stopper shaft and the electrode plates.
5. The fact that the pencil sharpener can be driven by either a primary battery or a secondary battery enables a lightweight and compact configuration, so that a portable pencil sharpener can be provided that can be operated even when an ac power source is not available.
6. A pencil sharpener can be provided that is not limited to the rotary blade type.
7. Accidental operation is prevented because in the core adjustment switch once the lower end of the core stopper shaft enters between the two electrode plates, the switch of the power source is maintained in the OFF state until the pencil is extracted.
8. The core adjustment switch has a simple structure composed of a slidable slide lever having a sloped surface and a manual adjustment lever, and is configured so that sliding the slide lever laterally moves the switchbox at an angle along the sloped surface to move it vertically.

DESCRIPTION OF THE PREFERRED EMBODIMENTS

Figure 1:
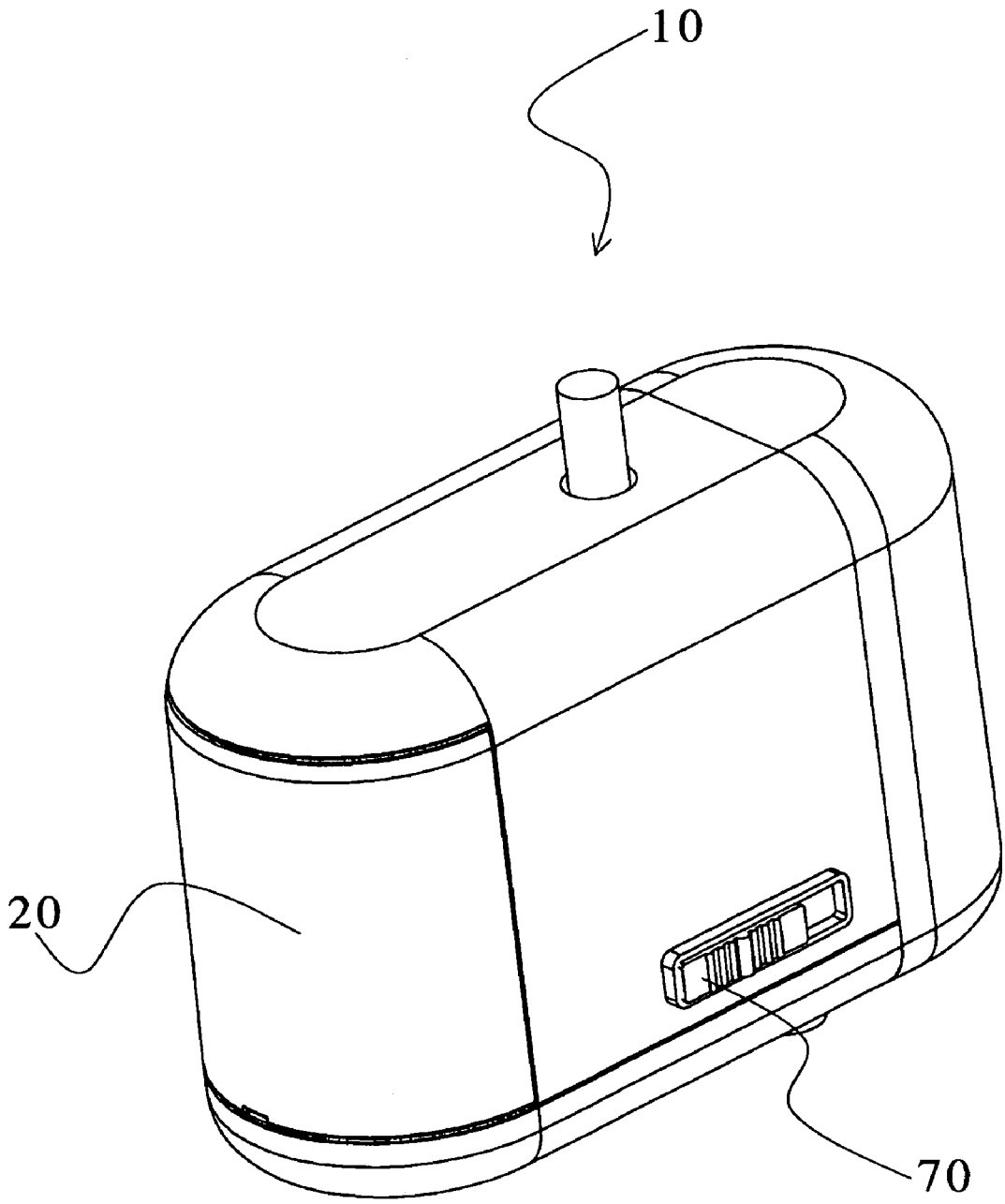
FIG. 1 is an overall perspective view of a pencil sharpener according to an embodiment of the present invention.
Figure 2:
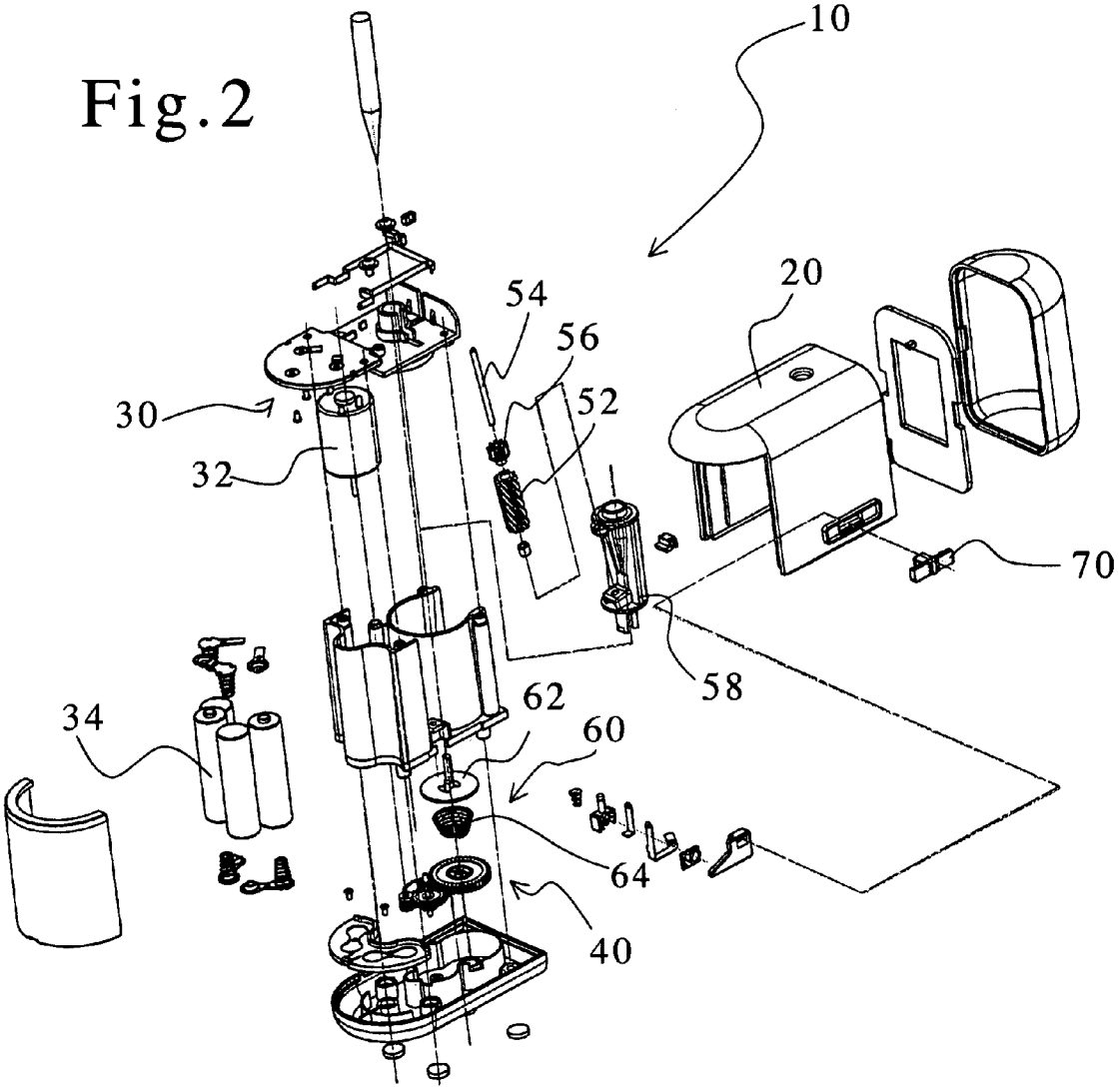
FIG. 2 is an exploded view of the pencil sharpener of FIG. 1.
Figure 3A:
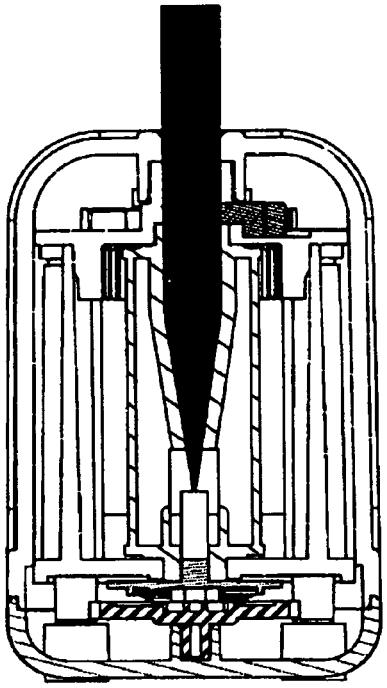
FIG. 3*a* is a sectional view of the pencil sharpener viewed from the left side.
Figure 3B:
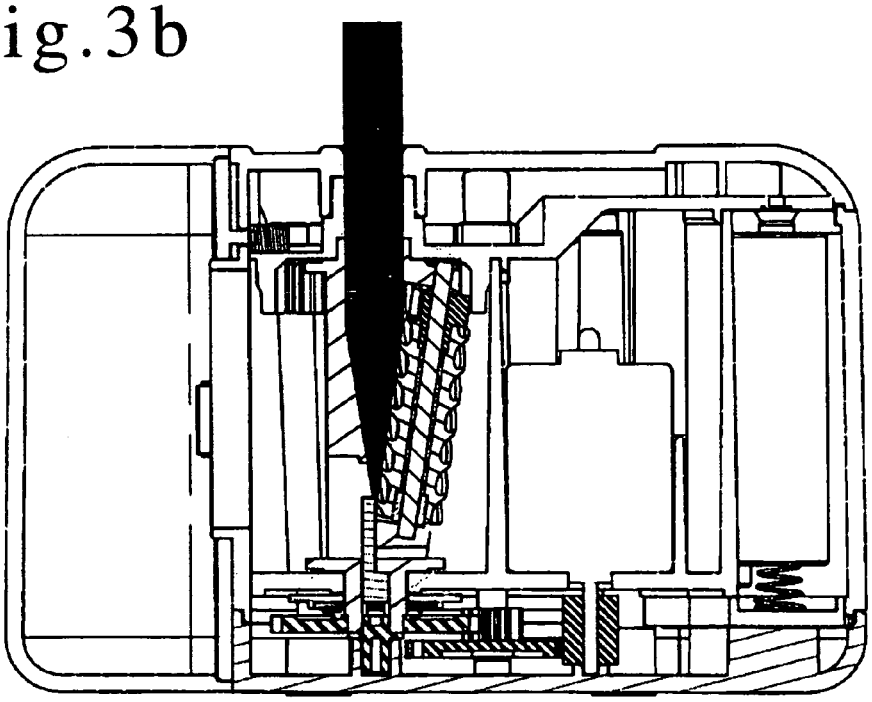
FIG. 3*b* is a sectional view of the pencil sharpener viewed from the front.
Figure 4:
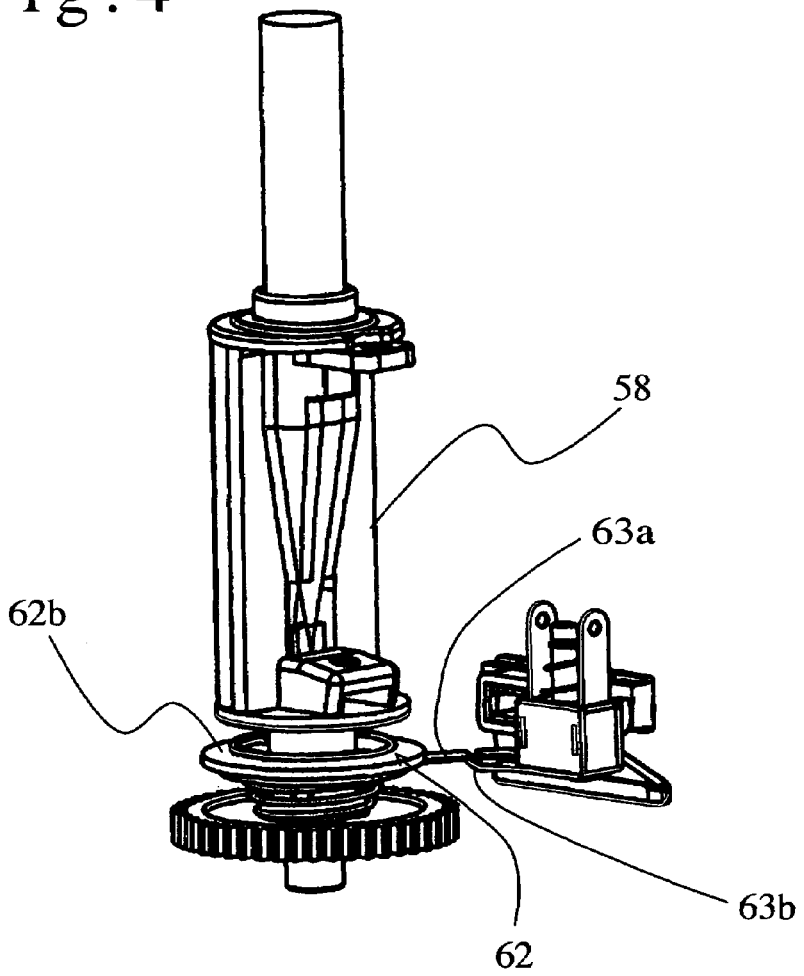
FIG. 4 is a perspective view showing an internal mechanism of a pencil sharpener according to a first embodiment of the present invention.
Figure 5:
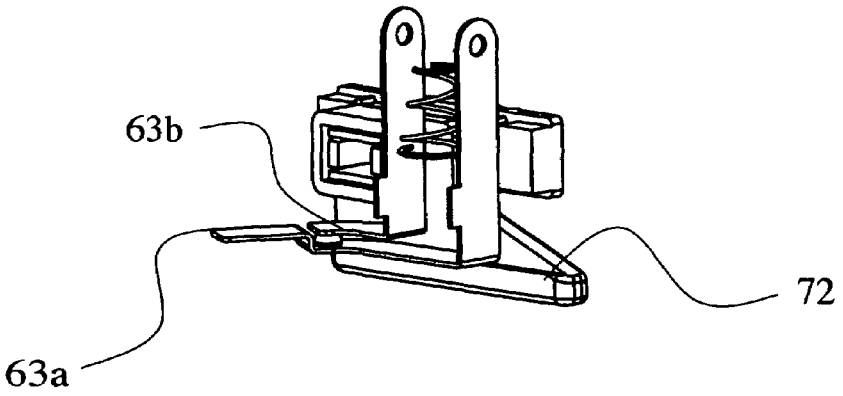
FIG. 5 is a perspective view showing a core adjustment switch of the pencil sharpener according to the first embodiment.
Figure 6:
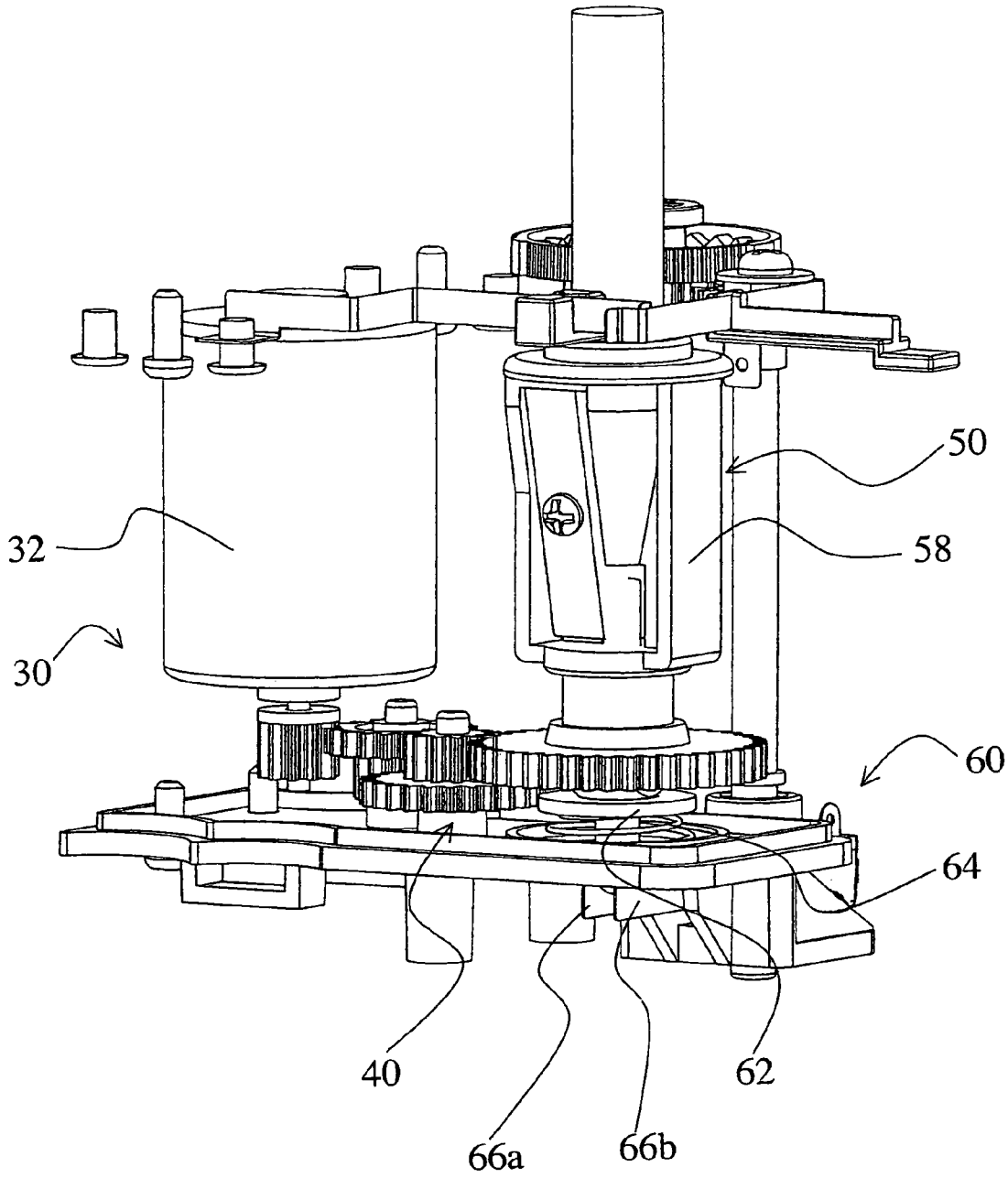
FIG. 6 is a perspective view showing the internal mechanism of a pencil sharpener according to a second embodiment of the present invention.
Figure 7:
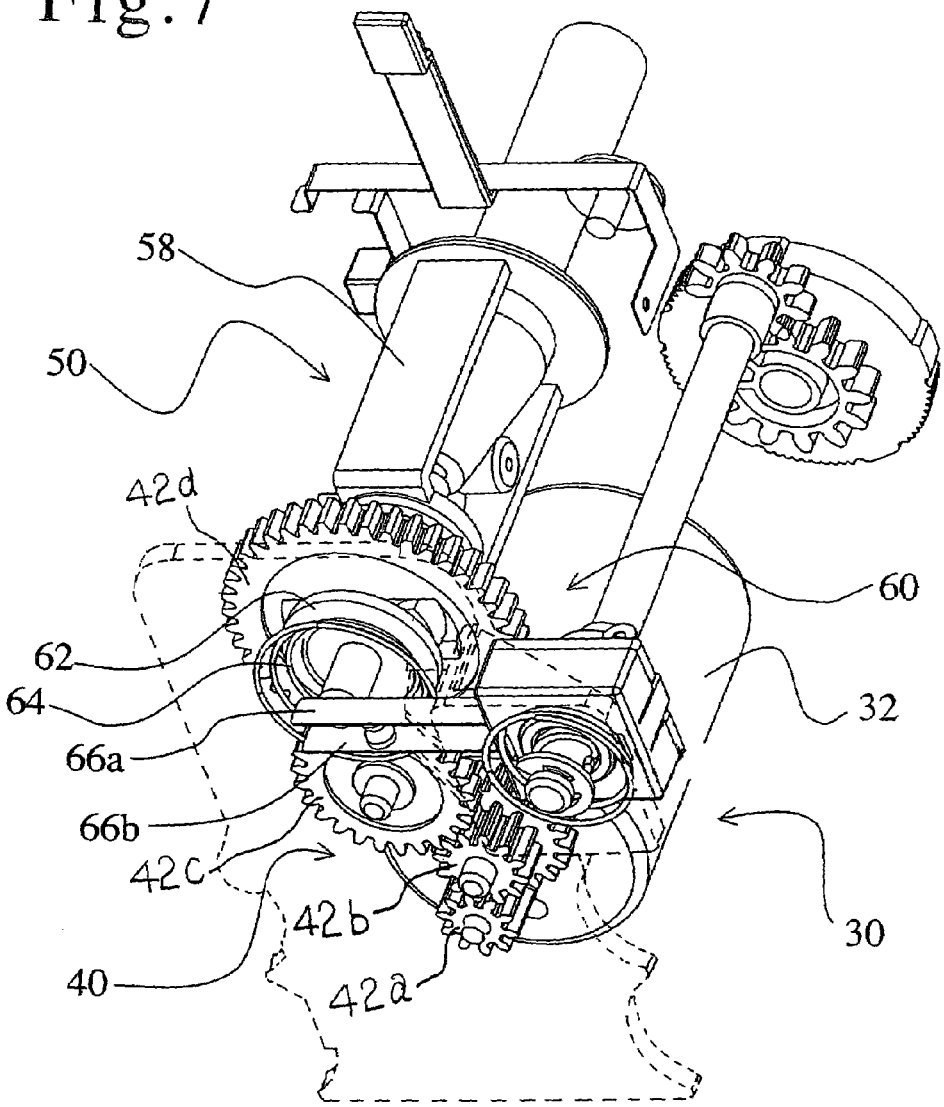
FIG. 7 is a perspective view showing the internal mechanism of the pencil sharpener according to the second embodiment.
Figure 8:
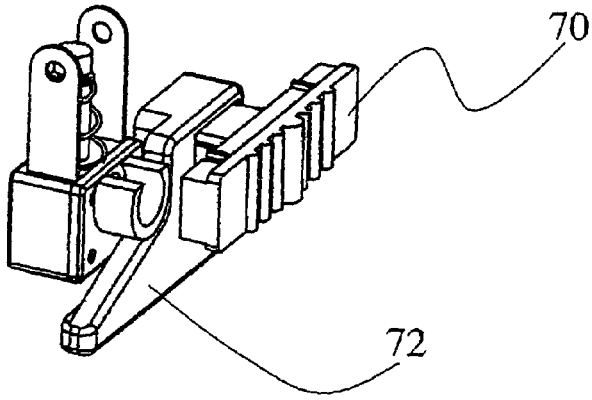
FIG. 8 is a perspective view showing a slide lever and an adjustment lever.

The pencil sharpener according to the invention will now be explained in detail with reference to preferred embodiments illustrated in the drawings.

First Embodiment

The pencil sharpener of this embodiment, designated by the symbol 10 in the drawings, comprises a frame 20, drive mechanism 30, transmission mechanism 40, cutting mechanism 50 and pencil-core adjustment mechanism 60.

The frame 20 constitutes a main unit housing the drive mechanism 30, transmission mechanism 40, cutting mechanism 50 and pencil-core adjustment mechanism 60. The pencil sharpener of this embodiment has an overall rounded box-like shape formed with a round pencil insertion hole on top for insertion of a pencil from above.

The drive mechanism 30 comprises a drive device 32 and an electric power supply unit 34. The drive device 32 is a motor in this embodiment. A gear is fitted on the output shaft of the motor. Power is transmitted from the drive device (motor) 32 to the transmission mechanism 40 through this gear. In this embodiment, rechargeable batteries (cells) or dry batteries (cells) are adopted for the electric power supply unit 34. Use of batteries is best because they enable the pencil sharpener to be carried about and used whenever and wherever desired. If the pencil sharpener is not required to be portable, it can be configured to be operable by ac current from, for example, an ac power source such as a wall socket. The pencil sharpener can also be made portable by equipping it with an external rechargeable battery or batteries.

The drive mechanism 30 is supplied with power from the electric power supply unit 34 through conductor plates. In this embodiment, a switch turns ON the power to operate the pencil sharpener when a pencil is inserted.

The transmission mechanism 40, which comprises a number of gears, transmits power from the drive mechanism 30 to the cutting mechanism 50. In this embodiment, the transmission mechanism 40 has four gears 42*a*, 42*b*, 42*c* and 42*d* through which power is transmitted from the motor (drive mechanism 30) to the cutting blade of the cutting mechanism 50.

The cutting mechanism 50 comprises a cutting blade 52, shaft 54, pinion gear 56 and cutter holder 58. The cutting mechanism 50, which is similar to the cutting mechanism of a conventional electric pencil sharpener, shaves (sharpens) a pencil by rotating the cutting blade 52.

The cutting blade 52 of this embodiment is equipped with a conventional helical rotary blade that rotates around its longitudinal axis. Use of a helical rotary blade is not mandatory, however, and it is alternatively possible to use a single-edge cutting blade that is rotated to perform cutting. Any type of blade is usable provided that it is capable of shaving a pencil.

In this embodiment, the shaft 54 is a rotary shaft inserted into the cutting blade 52 and the cutting blade is driven by the pinion gear to rotate around the shaft 54 and shave a pencil.

The pinion gear 56, which has a center hole, is sleeved onto the shaft 54 and comes into a meshed state with the cutting blade. In this embodiment, the pinion gear 56 is mounted on top of the cutting blade 52 and meshes with the cutting blade 52 to operate it.

The cutter holder 58 serves to immobilize an inserted pencil and has a hole at the bottom for insertion of a projection of the core stopper shaft 62. As in a conventional pencil sharpener, the cutter holder 58 operates by rotation in opposition to the cutting blade 52 during operation.

The pencil-core adjustment mechanism 60 comprises the core stopper shaft 62, an elastic body 64, and a pair of electrode plates, namely, a short electrode plate 63*a* and long electrode plate 63*b*. The electrode plates 63*a*, 63*b* are electrically connected to the electric power supply unit 34 through the conductor plates.

As shown in the drawings, the core stopper shaft 62 comprises a disk 62*b* and a rod. The projection 62*a* is inserted into a hole formed in the bottom of the cutter holder 58 to make contact with an inserted pencil, specifically with the tip of the shaved pencil. The bottom of the disk 64*b* is formed with a rod-like projection that is shorter than the upper projection. In this embodiment, the end of the long electrode plate 63*b* makes contact with the disk 64*b* to physically break electrical contact. To enable sure contact of the pencil with the core stopper shaft 62, a small block-like member is pinched between the tip of the pencil-core and the core stopper shaft, thereby ensuring reliable shaving of the pencil.

The disk 62*b* is made relatively large in this embodiment in order to ensure reliable coupling between the core stopper shaft 62 and elastic body 64. However, the disk 62*b* is only required to make contact with the long electrode plate 63*b* and is not limited to the particular configuration of this embodiment.

A generally circular coil spring is utilized as the elastic body 64 in this embodiment. More specifically, the coil spring of this embodiment is shaped like a cone having a center hole of a size enabling insertion of the projection 62*a* of the core stopper shaft 62.

The short electrode plate 63*b* and long electrode plate 63*a* are conductor plates that make contact through a protuberance formed on the long electrode plate 63*a*. They stay in contact through the protuberance during a pencil sharpening operation. During operation, the tip of the core of the shaved pencil presses down the core stopper shaft 62 so that the edge of the disk 62*b* makes contact with the long electrode plate 63*b* to break the contact between the protuberance and the short electrode plate 63*a* and turn OFF (terminate the operation) of pencil sharpener. Moreover, in the present embodiment the electrode plates can be moved vertically to adjust the thickness of the pencil-core.

The operation of the pencil sharpener of the first embodiment will now be explained.

The pencil sharpener of the present embodiment is provided with switches for control of electric power supply at two locations. One is the switch of the drive mechanism 30 situated in the pencil insertion hole and the other is the core adjustment switch constituted by the two electrode plates 63*a*, 63*b* provided in the pencil-core adjustment mechanism 60. An inserted pencil presses the switch of the drive mechanism 30 located near the insertion hole to start the cutting operation and shave (sharpen) the pencil. Once the pencil has been sharpened to a certain degree, it progresses downward owing to the slimmer profile of the tip region, eventually to press onto the core stopper shaft 62 and move it downward. As a result, the disk 62*b* of the core stopper shaft 62 makes contact with and presses down the long electrode plate 63*b*, thereby causing the protuberance of the long electrode plate making contact with the short electrode plate 63*a* to separate from the short electrode plate 63*a* to turn the core adjustment switch OFF and terminate the cutting operation. In an alternative configuration, the switch of the drive mechanism 30 turned ON when the pencil was inserted is also maintained OFF at this time.

The pencil sharpener of this embodiment is further provided with pencil-core adjustment capability. By pencil-core adjustment capability is meant the ability to regulate the thickness of the core of the pencil. This first embodiment is provided on the frame 20 with an adjustment lever 70 for implementing this feature. Manipulation of the adjustment lever 70 causes the short electrode plate 63*a* and long electrode plate 63*b* to move vertically. This changes the distance the disk 62*b* (and the tip of the pencil) needs to travel to make contact with the long electrode plate and turn OFF the core adjustment switch. It therefore adjusts the thickness of the pencil-core.

Second Embodiment

The drive mechanism 30, transmission mechanism 40 and cutting mechanism 50 of the second embodiment of the pencil sharpener are the same as those of the first embodiment.

The pencil-core adjustment mechanism 60 comprises the core stopper shaft 62, the elastic body 64, and a pair of electrode plates 66*a*, 66*b*. The electrode plates 66 are electrically connected to the electric power supply unit 34 through the conductor plates.

As shown in the drawings, the core stopper shaft 62 comprises a disk and a rod. The projection 62*a* is inserted into a hole formed in the bottom of the cutter holder 58 to make contact with an inserted pencil, specifically with the tip of the shaved pencil. The bottom of the disk 64*b* is formed with a rod-like projection shorter than the upper projection that enters between the mutually contacting electrode plates 66*a*, 66*b* to physically break the electrical contact. To enable sure contact of the pencil with the core stopper shaft 62, a small block-like member is pinched between the tip of the pencil-core and the core stopper shaft, thereby ensuring reliable shaving of the pencil.

The disk 62*b* is made relatively large in this embodiment in order to ensure reliable coupling between the core stopper shaft 62 and elastic body 64. However, the elastic body is not limited to the particular configuration of this embodiment.

A generally circular coil spring is utilized as the elastic body 64 in this embodiment. More specifically, the coil spring of this embodiment is shaped like a cone having a center hole of a size enabling insertion of the projection of the core stopper shaft 62.

The two electrode plates 66*a*, 66*b* are constituted as a pair of parallel conductor plates provided at a prescribed location with facing projections. The projections stay in contact with each other when a pencil is being sharpened. In the course of this operation, the tip the core of the sharpened pencil moves downward to press the core stopper shaft 62 downward, so that the rod at the bottom of the projection 62*a* enters between the two electrode plates to separate the projections, thereby breaking the electrical contact and stopping the operation of the pencil sharpener. Moreover, in the present embodiment the electrode plates can be moved vertically to adjust the thickness of the pencil-core.

The operation of the pencil sharpener of the second embodiment will now be explained The pencil sharpener of the present embodiment is provided with switches for control of electric power supply at two locations. One is the switch of the drive mechanism 30 situated in the pencil insertion hole and the other is the core adjustment switch constituted by the two electrode plates 66 provided in the pencil-core adjustment mechanism 60. An inserted pencil presses the switch of the drive mechanism 30 located near the insertion hole to start the cutting operation and shave (sharpen) the pencil. Once the pencil has been sharpened to a certain degree, it progresses downward owing to the slimmer profile of the tip region, eventually to press down on the core stopper shaft 62. As a result, the core stopper shaft 62 moves downward so that the rod-like projection at the bottom of the core stopper shaft 62 enters between the two electrode plates 66 to separate the projections of the electrode plates that have been in contact up to that point, thereby turning OFF the core adjustment switch and stopping the cutting operation. In an alternative configuration, the switch of the drive mechanism 30 turned ON when the pencil was inserted is also maintained OFF at this time.

The pencil sharpener of this embodiment is further provided with pencil-core adjustment capability. By pencil-core adjustment capability is meant the ability to regulate the thickness of the core of the pencil. This second embodiment is provided on the frame 20 with the adjustment lever 70 for implementing this feature. Manipulation of the adjustment lever 70 operates a slide lever 72 formed with a sloped surface and a protuberance formed on the core adjustment switch moves together with the slide lever 72 to raise or lower the core adjustment switch. This changes the distance the core stopper shaft 62 (and the tip of the pencil) needs to travel for the core stopper shaft 62 to make contact with or enter between the electrode plates and stop the supply of power. It therefore adjusts the thickness of the pencil-core.

Although the adjustment lever 70 is of the sliding type in this embodiment, this invention is not limited to use of a sliding lever and it is possible instead to use any of various other types of lever including, for example, a rotary adjustment lever. Since the electrode plates 66 move vertically, it is conceivable to make the conductor plates between the electrode plates and the electric power supply unit long and adopt a slide contact configuration, while it is also possible to utilize wire conductors.

The pencil sharpener according to the present invention is electrically powered and compact. As such, it has the merit of being light in weight and easy to carry on one's person. Although it can be powered by various types of batteries, including secondary (rechargeable) batteries, disposable dry cells (batteries) are the power supply of choice. The pencil sharpener can also be equipped to operate on home (e.g., 100 V) ac line current. Configurations are also possible that can be powered by a dc power source such as an appropriate external ac-dc conversion adapter or an internally installed ac-dc converter.

The present invention is characterized in the points that the electrically conductive state of mutually contacting electrode plates is forcibly broken by pressing the electrode plates apart and that the pencil-core adjustment mechanism comprising the electrode plates can be moved up and down so as to change the distance that the core stopper shaft travels to make contact with the electrode plates and thus regulate the pencil-core thickness.

The lower end of the core stopper shaft is forcibly pushed onto the electrode plates that are in contact with each other so as to break their electrically conductive state. When the pencil is thereafter extracted, the core stopper shaft instantaneously departs from the electrode plates owing to the departure of the tip of the pencil-core, so that the electrode plates come into contact again to reestablish the electrically conductive state. However, this reestablishment of the electrical continuity is not a major problem because it is only momentary, owing to the fact that the supply of power is promptly turned OFF as the user continues to extract the pencil from the pencil sharpener. Still, if desired, it is possible to prevent this momentary reestablishment of the electrically conductive (ON) state in the course of pencil extraction after the pencil sharpener has once stopped following completion of pencil sharpening. This can be achieved by adding means for turning OFF the main power supply of the pencil sharpener to the means for breaking the electrically conductive state of the pencil-core adjustment mechanism.

The present disclosure relates to subject matter contained in Japanese Application No. 2004-299182, filed on Oct. 13, 2004, the contents of which are herein expressly incorporated by reference in its entirety.

The invention claimed is:

1. A pencil sharpener comprising:

a frame;

a drive mechanism composed of a drive device and an electric power supply unit;

a transmission mechanism comprising a gear train that transmits power from the drive mechanism;

a cutting mechanism equipped with at least one cutting blade that is driven by power from the transmission mechanism to shave a pencil; and a pencil-core adjustment mechanism straddling the drive mechanism and cutting mechanism that adjusts the thickness of a pencil-core, in which pencil sharpener:

the pencil-core adjustment mechanism comprises a core stopper shaft composed of a disk and an upper end on which the tip of a pencil strikes, an elastic body that is provided with a center hole and pressed by the core stopper shaft, and a core adjustment switch composed of a short electrode plate and a long electrode plate that is formed with a protuberance that contacts the short electrode plate and which extends to enable one end thereof to contact the disk of the core stopper shaft, and a pencil inserted into the cutting mechanism presses against and turns ON a switch provided in the drive mechanism to transmit power from the electric power supply unit to the drive device, thereby operating the cutting mechanism via the transmission mechanism to sharpen the pencil, and pressing of the pencil against the upper end of the core stopper shaft causes the disk of the core stopper shaft to contact and press down one end of the long electrode plate to separate the protuberance of the long electrode plate from the short electrode plate, thereby turning OFF the core adjustment switch and stopping the supply of power to terminate the operation.

2. A pencil sharpener comprising:

a frame;

a drive mechanism composed of a drive device and an electric power supply unit;

a transmission mechanism comprising a gear train that transmits power from the drive mechanism;

a cutting mechanism equipped with at least one cutting blade that is driven by power from the transmission mechanism to shave a pencil; and a pencil-core adjustment mechanism straddling the drive mechanism and cutting mechanism that adjusts the thickness of a pencil-core, in which pencil sharpener:

the pencil-core adjustment mechanism is constituted of a core stopper shaft composed of an upper end and a lower end that is a generally rod shaped body adapted to enter between electrode plates, an elastic body that is provided with a center hole and pressed by the core stopper shaft, and two electrode plates installed in parallel under the elastic body and provided with projections to make contact at one point, and a pencil inserted into the cutting mechanism presses against and turns ON a switch provided in the drive mechanism to transmit power from the electric power supply unit to the drive device, thereby operating the cutting mechanism via the transmission mechanism to sharpen the pencil, and pressing of the pencil against the upper end of the core stopper shaft causes the lower end of the core stopper shaft to enter between the two electrode plates to separate the contacting projections, thereby breaking the contact between the electrode plates and stopping the supply of power to terminate the operation.

3. A pencil sharpener according to claim 1, wherein the core adjustment switch comprises two electrode plates that extend in parallel from a switchbox and move vertically in response to a core adjustment operation from the outside.

4. A pencil sharpener according claim 1, wherein adjustment of pencil-core length is enabled by making the electrode plates vertically movable to adjust the distance the core stopper shaft moves to enter between the electrode plates.

5. A pencil sharpener according to claim 1, wherein the electric power supply unit is at least one rechargeable battery or dry battery.

6. A pencil sharpener according to claim 1, wherein the at least one cutting blade is a rotating blade or a single-edge blade.

7. A pencil sharpener according to claim 1, wherein the core adjustment switch is configured so that once the lower end of the core stopper shaft is inserted between the two electrode plates the switch of the drive mechanism is maintained OFF until the pencil is extracted.

8. A pencil sharpener according to claim 1, wherein the core adjustment switch comprises a slidable slide lever having a sloped surface and a manual adjustment lever, and configured so that sliding the slide lever laterally moves a switchbox at an angle along the sloped surface to move it vertically.

9. A pencil sharpener according to claim 2, wherein the core adjustment switch comprises two electrode plates that extend in parallel from a switchbox and move vertically in response to a core adjustment operation from the outside.

10. A pencil sharpener according claim 2, wherein adjustment of pencil-core length is enabled by making the electrode plates vertically movable for adjusting the distance the core stopper shaft moves to enter between the electrode plates.

11. A pencil sharpener according to claim 2, wherein the electric power supply unit is at least one rechargeable battery or dry battery.

12. A pencil sharpener according to claim 2, wherein the at least one cutting blade is a rotating blade or a single-edge blade.

13. A pencil sharpener according to claim 2, wherein the core adjustment switch is configured so that once the lower end of the core stopper shaft is inserted between the two electrode plates the switch of the drive mechanism is maintained OFF until the pencil is extracted.

14. A pencil sharpener according to claim 2, wherein the core adjustment switch is constituted of a slidable slide lever having a sloped surface and a manual adjustment lever, and configured so that sliding the slide lever laterally moves a switchbox at an angle along the sloped surface to move it vertically.

* * * * *